US006325226B1

(12) United States Patent
Krautkramer

(10) Patent No.: US 6,325,226 B1
(45) Date of Patent: Dec. 4, 2001

(54) PLASTIC SCREW CLOSURE

(75) Inventor: Gunter Krautkramer, Budenheim (DE)

(73) Assignee: Bericap GmbH & Co. KG (DE)

( * ) Notice: Subject to any disclaimer, the term of this patent is extended or adjusted under 35 U.S.C. 154(b) by 0 days.

(21) Appl. No.: 09/367,443

(22) PCT Filed: Jan. 29, 1998

(86) PCT No.: PCT/DE98/00266

§ 371 Date: Oct. 28, 1999

§ 102(e) Date: Oct. 28, 1999

(87) PCT Pub. No.: WO98/35881

PCT Pub. Date: Aug. 20, 1998

(30) Foreign Application Priority Data

Feb. 14, 1997 (DE) ..... 197 05 717

(51) Int. Cl.[7] ..... B65D 41/34; B65D 53/00

(52) U.S. Cl. ..... 215/252; 215/253; 215/258; 215/344; 215/901

(58) Field of Search ..... 215/252, 211–214, 215/217, 223, 250, 253, 256, 258, 329, 330, 341, 342, 343, 344, 345, 354, DIG. 1; 220/265, 266, 268, 276, 288, 304

(56) References Cited

U.S. PATENT DOCUMENTS

| | | | | |
|---|---|---|---|---|
| 4,322,012 | * | 3/1982 | Conti | 215/344 |
| 4,489,845 | * | 12/1984 | Aichinger et al. | 215/329 |
| 4,564,112 | * | 1/1986 | Breuer | 215/246 |
| 5,297,688 | * | 3/1994 | Beck et al. | 215/344 |
| 5,803,286 | * | 9/1998 | Pfefferkorn et al. | 215/344 X |
| 5,871,111 | * | 2/1999 | Pfefferkorn et al. | 215/329 X |
| 5,964,363 | * | 10/1999 | Kelly et al. | 215/252 |
| 6,021,912 | * | 2/2000 | Hertrampf | 215/344 |

FOREIGN PATENT DOCUMENTS

| | | |
|---|---|---|
| 1 196 606 | 11/1985 | (CA) . |
| 2012047 | 9/1990 | (CA) . |
| 3139526 | 4/1983 | (DE) . |
| 4008010 | 10/1990 | (DE) . |
| 4128474 | 3/1993 | (DE) . |
| 0114127 | 7/1984 | (EP) . |
| 0 529 383 | 6/1997 | (EP) . |
| 96/02430 * | 2/1996 | (WO) . |

* cited by examiner

*Primary Examiner*—Stephen P. Garbe
*Assistant Examiner*—Niki M. Eloshway
(74) *Attorney, Agent, or Firm*—Killworth, Gottman, Hagan & Schaeff, LLP

(57) ABSTRACT

A plastic screw closure for bottles comprising a cap having a substantially cylindrical peripheral portion (1) with an internal screw thread (8) for screwing onto an external screw thread (11) of a bottle neck (10), and with a disc-like top plate portion (2). A substantially cylindrical sealing strip (4) which extends axially from the inside of the top plate portion (2) has an outside diameter at least equal to the bottle neck's outside diameter (D) and an inside diameter ($2r_2$) smaller than the bottle neck's outside diameter (D). Inside the cylindrical sealing strip (4), a further, substantially cylindrical sealing olive-shaped button (3) is radially fitted, the outside diameter ($2R_1$) of which, at least in the area near the top plate and opposite the sealing strip (4), is larger than the inside diameter (d) of the bottle neck (10).

19 Claims, 2 Drawing Sheets

PLASTIC SCREW CLOSURE

BACKGROUND OF THE INVENTION

The present invention concerns a plastic screw closure for bottles, comprising a substantially cylindrical peripheral portion with an internal screwthread for screwing onto the external screwthread of a bottle neck, and a top plate portion which is substantially in the form of a circular disc and a substantially cylindrical sealing strip which extends axially inwardly from the inside of the top plate portion and whose outside diameter approximately corresponds to the outside diameter of the bottle neck or is slightly larger and whose inside diameter is clearly smaller than the outside edge of the bottle neck.

A plastic screw closure of that kind for bottles is already known from DE 41 28 474.

The known plastic screw closure is intended for screwing onto the screwthreaded neck of bottles and is of such a design configuration that the substantially cylindrical strip bears from above and the outside onto the edge of the bottle neck and in so doing bears sealingly substantially along the upper outer rounded-off edge of the bottle neck or the mouth of the bottle. In that arrangement, the sealing strip is additionally also clamped between an outer substantially cylindrical bead or ridge and the bottle neck and is pulled and pressed into firm sealing engagement with the edge of the bottle neck. In principle such a closure could also be used for plastic bottles, for example PET-bottles.

In the case of multi-use bottles made of glass, the bottles generally and in particular also the bottle necks and mouth openings are visually checked before they are reused. In that respect however the possibility cannot be excluded, that damage to the edge of the bottle neck in the region where it comes into sealing engagement with the closure cap or sealing elements of the closure cap is overlooked, particularly if such damage is relatively small and inconspicuous. In principle that also applies for plastic bottles, in particular for the PET-bottles which are increasingly used. When dealing with plastic bottles, under some circumstances, due to the production procedure involved it is also necessary to reckon on rather larger manufacturing tolerances or damage occurring in the course of manufacture or handling. Minor damage, in particular in the form of small dents or grooves, can only be visually detected with difficulty. It can therefore certainly happen that bottles are filled and closed, when the edge of the bottle neck thereof has suffered minor damage, deformation or unevenness and irregularities caused by the manufacturing procedure and which are easily overlooked in a checking operation but which are sufficient to have an adverse effect on the sealing engagement between the edge of the bottle neck and sealing elements of the closure cap. That applies in particular if the interior of the bottle is under pressure, for example when using the bottles for carbonated drinks. A poor seal in the case of such bottles can have the result that gas escapes from the bottle and as a result causes a drop in pressure, which in turn results in outgassing of the carbon dioxide contained in the drink, which then after a storage time of some days or weeks, has substantially lost its carbon dioxide and correspondingly tastes stale.

WO 96/02430 already discloses a closure cap which is intended to ensure particularly good sealing engagement. Instead of a substantially cylindrical sealing strip, this known closure cap however has a substantially horizontally extending sealing strip which bears against the upper edge of the bottle neck, while in addition annular projections are provided at the bottom or the top plate portion of the closure cap and are intended to come into engagement with the sealing strip on the side thereof in opposite relationship to the edge of the bottle neck, and apply a linear sealing pressure to the sealing strip. The arrangement additionally also has an inner substantially cylindrical sealing olive, in which respect the term "olive" clearly defines the lower cross-section of that part which has an outwardly projecting region which is also intended to come into substantially linear engagement with the cylindrical inside surface of the bottle neck. Admittedly, the inside surface of a bottle neck is generally fairly precisely defined, at least in the case of PET-bottles, but it may certainly involve damage, so that the projection of the sealing olive cannot guarantee reliable sealing integrity, in spite of the substantially linear engagement of the sealing olive with the interior of the bottle neck. In addition, the sealing projection of the known closure is disposed at a considerable spacing relative to the point of attachment of the sealing plate portion to the top plate portion so that the arrangement does not afford very high elastic return or contact pressure forces in the region of the projection.

A substantially radially extending sealing plate admittedly partially covers over the outer, generally well-defined, rounded-off edge of the bottle neck which however can also be damaged, but just like the sealing olive it does not involve the inner, slightly rounded-off edge configuration of the edge portion of the bottle neck. These parts which are positioned in different ways relative to the axis of the closure define a blind hole-like depression with a considerable undercut configuration which gives rise to major problems in manufacture and in the operation of pressing out air, which is required in that context.

WO 96/26121 discloses a corresponding screw closure which, besides a substantially conically outwardly directed, peripherally extending sealing plate which is intended to come into engagement with the outer edge of the bottle neck, additionally also has an inner centering projection whose outside diameter however is somewhat smaller than the inside diameter of the bottle neck. That projection therefore does not come into sealing engagement with the interior of the bottle neck and in particular not with the upper inner edge of the bottle neck.

Because of the conical shape of the sealing plate, removal of such a closure from an injection moulding tool is a relatively difficult and complicated procedure. That applies even more in regard to the above-mentioned closure disclosed in WO 96/02430 in which the sealing plate extends parallel to the top plate portion radially inwardly virtually in one plane and, together with a further inwardly disposed sealing olive, defines a virtually closed hollow space or cavity.

The known closures therefore have at least in part problems in terms of manufacture and in particular removal from a mould and on the other hand they still do not guarantee absolutely sound sealing integrity in the event of minor damage or deformation of the edge of the bottle neck.

SUMMARY OF THE INVENTION

In comparison with that state of the art, the object of the present invention is to provide a plastic screw closure having the features set forth in the opening part of this specification, which still better prevents leaks in the event of slight damage or deformation of the edge of the bottle neck and which in addition if possible should be easily removable from a mould in order to facilitate manufacture with an injection moulding tool which is of the simplest possible structural configuration.

That object is attained in that the plastic screw closure, in addition to the features set forth in the opening part of this specification, includes the further features that provided radially within the cylindrical sealing strip is a further, substantially cylindrical sealing olive whose outside diameter at least in the region near the top plate portion and opposite to the sealing strip is larger than the inside diameter of a bottle neck for which the closure is intended.

While the outer sealing strip which is approximately of the configuration as in the case of known DE 41 28 474 thus provides for really good sealing integrity in respect of the upper outer edge of the bottle neck, there is additionally provided an inner sealing olive which additionally also seals off the inside surface at the upper edge of the bottle neck. The latter effect is achieved in that, in the region which is near the top plate portion and opposite to the sealing strip, that is to say in the region in which, when the closure is screwed onto a bottle, the upper edges of the bottle neck normally also lie, the sealing olive is still of a larger outside diameter than the inside diameter of the bottle neck or the edge of the bottle neck in that region, so that therefore the inner sealing olive is urged away radially inwardly and, when that happens, it bears sealingly against the inside surface of the edge of the bottle neck. The diameter conditions in regard to the sealing strip and the sealing olive necessarily mean that, in a given axial position and in particular in the axial region in which the upper edge of the bottle neck is disposed, the internal spacing between the sealing strip and the sealing olive must be smaller than corresponds to the thickness of the edge of the bottle neck. In that respect, a particularly preferred embodiment of the invention is one in which the internal spacing between the sealing strip and the sealing olive in the sealing region is less than two thirds and under some circumstances even less than half the thickness of the bottle neck. Since both, the sealing olive and the sealing strip preferably comprise the plastic material of the closure, they enjoy sufficient elasticity to be urged away by the edge of the bottle neck when the closure is fitted onto the bottle and is screwed fast, while however coming into very firm sealing engagement with the upper edge of the bottle neck, by virtue of the elastic return forces which occur in that case.

In addition, the preferred embodiment of the invention provides that, on its outside, the sealing olive has a shallow bead or ridge which in cross-section is approximately in the shape of an obtuse triangle.

In that respect, it is to be borne in mind that the fact that the inner projection is urged radially inwardly is equivalent to compression of the material which constitutes the sealing olive. The bead which is of a correspondingly larger outside diameter on the one hand comes into sealing engagement with the inside surface of the edge of the bottle neck and in so doing causes greater compression of the material constituting the sealing olive and thus an increase in the elastic return force which ultimately ensures reliable and secure sealing engagement.

At its free end the sealing olive is preferably rounded-off and/or bevelled so that, in the event of axial movement in the direction of the bottle neck, the sealing olive is also actually urged radially inwardly and does not rest on the edge of the bottle neck or is not urged radially outwardly.

In a similar fashion, in the preferred embodiment the sealing strip, at its free end, is also of a rounded-off and/or bevelled shape so that upon axial movement in a direction towards the bottle neck it is spread radially outwardly when it comes into engagement with the edge of the bottle neck.

Overall the preferred alternative configurations of the sealing strip and the sealing olive can be characterised to the effect that deviations thereof from a precise hollow-cylindrical shape are essentially limited to the outside wall of the projection and the inside wall of the sealing strip. In that respect, in the preferred embodiment, the olive is approximately twice as thick and at least 50% longer (in the axial direction) than the sealing strip. Preferably, the axial length of the sealing olive is even about twice the axial length of the sealing strip. By virtue of that relatively massive configuration of the sealing olive, in the preferred embodiment of the invention, the deviation of the outside diameter of the sealing olive from the diameter of the edge of the bottle neck, at any event in the region where the sealing action essentially occurs, is less than the corresponding deviation of the inside diameter of the sealing strip from the outside diameter of the edge of the bottle neck as the sealing strip is thinner and shorter and can thus be more easily elastically stretched and moved away.

Preferably the outside surfaces of the sealing olive and the inside surface of the sealing strip extend substantially parallel over the axial extent of the sealing strip, that is to say, over the length of the sealing strip, there is a substantially constant internal width between the sealing olive and the sealing strip, and the outside surface of the sealing olive extends, particularly at the axial height of the end of the sealing strip, parallel to the bevelled and round-off shape thereof. In cross-section therefore the hollow space or cavity which is formed between the sealing olive and the sealing strip is of a narrow configuration which is slightly concavely curved and rounded-off at the top, and the hollow space or cavity is open at its lower end and closed at the top. In that arrangement, in terms of cross-section, the hollow space or cavity which extends in a slightly curved configuration from bottom to top, is of a substantially constant width and decreases in width only at its upper closed and rounded-off end, while the upper portion, with respect to the axis of the closure, is almost cylindrical and the lower portion enlarges outwardly in a conical configuration. The axial length of the hollow space or cavity which is markedly narrower than the thickness of the associated bottle neck is defined by the length of the outer sealing strip which is in turn relatively short so that, in the condition of being screwed onto a bottle neck, it thus just completely embraces the outer, rounded-off edge of the bottle neck. That means that the narrow hollow space or cavity between the sealing olive and the sealing strip remains axially correspondingly short, which facilitates the manufacturing operation and also makes the configuration of a suitable injection moulding tool simpler. In specific terms, this hollow space or cavity is of an axial depth (corresponding to the axial length of the sealing strip) of less than 4 mm, preferably less than 3 mm and in particular about 2 to 2.5 mm.

The free end of the peripheral portion of the screw closure is preferably integrally provided with a guarantee or anti-tamper and tear-off band. As also generally, the closure in the preferred embodiment is produced in one piece from a homogenous plastic material using injection moulding. The substantially cylindrical shapes of the sealing olive and the sealing strip and the short axial length thereof permit relatively easy and simple removal of the moulded article from the mould and also allow the manufacturing tool to be of a correspondingly simple shape.

BRIEF DESCRIPTION OF THE DRAWINGS

Further advantages, features and possible uses of the present invention will be clearly apparent from the following description of a preferred embodiment and the accompanying drawings in which.

DETAILED DESCRIPTION OF THE PREFERRED EMBODIMENTS

Figure 1A:
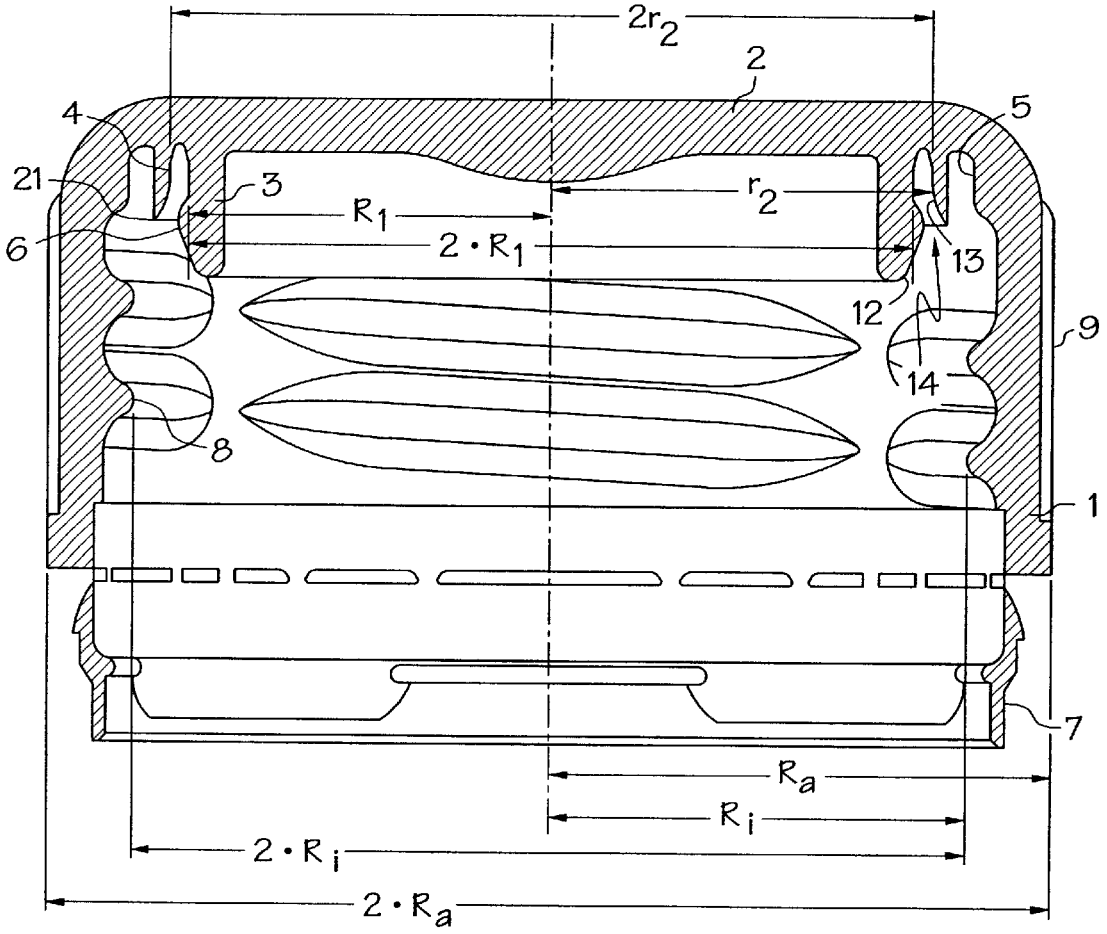
FIG. 1*a* shows the screw closure according to the invention in a sectional view containing the axis, on an enlarged scale.

FIG. 1*a* shows the screw closure according to the invention, in a longitudinal section containing the axis thereof. The screw closure substantially comprises a cylindrical peripheral portion 1 with a top plate portion 2 which is integrally joined thereto and which is approximately in the shape of a circular disc. An anti-tamper and tear-off band 7 is also attached to the free end of the cylindrical peripheral portion 1, also in one piece with the peripheral portion 1. The anti-tamper and tear-off band 7, by unscrewing of the screw cap, is torn open by a bottle or tears off the peripheral portion 1 and thus identifies that the bottle has already been opened.

The cylindrical peripheral portion 1 has an internal screwthread 8 which is interrupted in portions thereof, while on its outside it has gripping knurling 9 which is intended to make it easier to apply torque when gripping the closure cap with the fingers.

The two elements which afford sealing integrity with the bottle neck are the cylindrical sealing strip 4 which extends in an annular configuration around the closure and the sealing olive 3 which also extends in an annular configuration and parallel to the sealing strip 4. As can be seen, the outside wall of the sealing strip 4 and the inside wall of the cylindrical sealing olive 3 extend straight in the cross-sectional view and are thus fairly precisely cylindrical. The inside wall of the cylindrical sealing strip 4 having an inside diameter $2r_2$, which clearly smaller than an outside diameter D of the bottle neck (FIG. 2), extends parallel to the axis of the closure, only over a relatively short portion, and is then rounded-off in the direction of the free end 21 and extends inclinedly outwardly. The outside wall of the cylindrical olive 3 has a bead or ridge 6 which is shallow in cross-section, approximately in the form of an obtuse-angled triangle, wherein the obtuse angle of the obtuse-angled triangle defines the maximum outside diameter of the bead or projection 3 and axially, approximately coincides with the free end 21 of the sealing strip 4. Then, towards the top plate portion 2, the outside wall of the cylindrical sealing olive 3, starting from the bead or ridge, extends approximately parallel to the end portion which extends in an inclined and rounded-off configuration, before it again extends approximately parallel to the axis and then follows an arcuate path to blend into the inside wall of the sealing strip 4. The mutually facing surfaces of the sealing strip 4 and the sealing olive 3 extend parallel over the greatest part of the axial length of the sealing strip 4.

The axial length of the sealing olive 3 is greater than the axial length of the sealing strip 4 by at least 50% and preferably by about 100%.

The deviations of the hollow-cylindrical shape of the sealing olive 3 and the sealing strip 4 are substantially limited to the outside wall 12 of the sealing olive and the inside wall 13 of the sealing strip 4.

In cross-section therefore the hollow space or cavity 14 which is formed between the sealing olive 3 and the sealing strip 4 is of a narrow configuration which is slightly concavely curved and rounded-off at the top, and the hollow space or cavity is open at its lower end and closed at the top. The internal spacing $(r_2-R_1)$ between the sealing strip 4 and the sealing olive 3 in the sealing region is less than two thirds and optionally less than half the thickness $|D-d|$ (FIG. 2) of the bottle neck 10. In that arrangement, in terms of cross-section, the hollow space or cavity 14 which extends in a slightly curved configuration from bottom to top, is of a substantially constant width and decreases in width only at its upper closed and rounded-off end, while the upper portion, with respect to the axis of the closure, is almost cylindrical and the lower portion enlarges outwardly in a conical configuration. The axial length of the hollow space or cavity which is markedly narrower than the thickness of the associated bottle neck is defined by the length of the outer sealing strip 4 which is in turn relatively short so that, in the condition of being screwed onto a bottle neck, it thus just completely embraces the outer, rounded-off edge 15 (FIG. 2) of the bottle neck. That means that the narrow hollow space or cavity 14 between the sealing olive 3 and the sealing strip 4 remains axially correspondingly short, which facilitates the manufacturing operation and also makes the configuration of a suitable injection molding tool simpler. In specific terms, this hollow space or cavity 14 is of an axial depth (corresponding to the axial length of the sealing strip) of less than 4 mm, preferably less than 3 mm, and in particular about 2 to 2.5 mm.

Figure 1B:
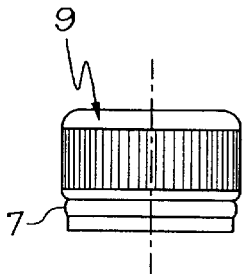
FIG. 1*b* shows a side view of the screw closure of FIG. 1*a*, approximately in original size.
Figure 2:
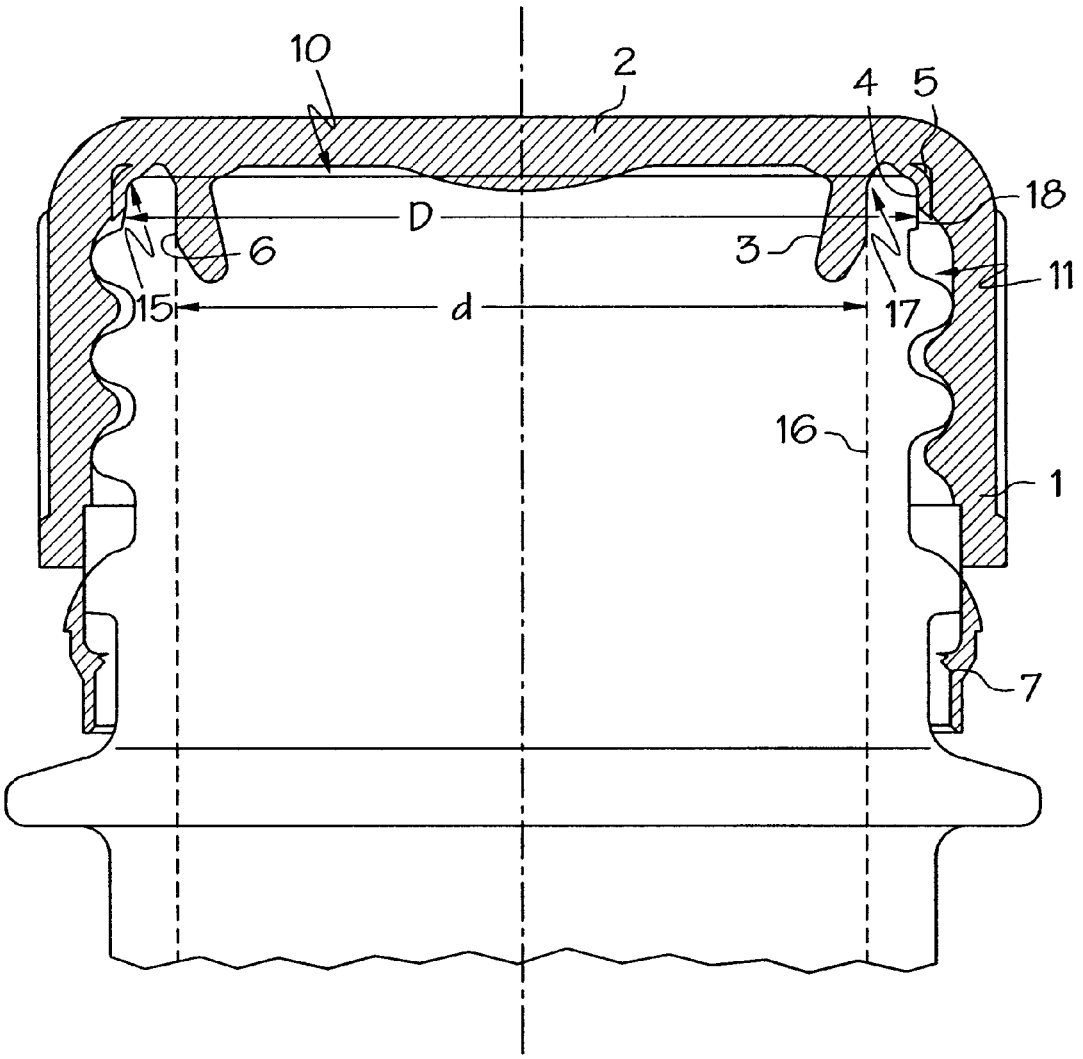
FIG. 2 shows the closure of FIG. 1 in the same axial sectional plane but in a condition of being screwed onto a bottle neck.

FIG. 1*b* shows a side view of the closure in approximately natural size. The drawing clearly shows the knurling 9 on the outside of the screw cap, which is intended to make it easier to screw the closure on and off, as well as the lower anti-tamper and tear-off band 7. In other respects the closure is shown in FIGS. 1 and 2 precisely true to scale, the dimension $R_a$ being somewhat less than 31 mm. Because the view is shown to scale, that dimension can be used as a basis for exactly deriving all other dimensions, and the absolute and relative dimensions of all elements are disclosed in the Figures, by virtue of the views being true to scale. It will be appreciated however that the invention is not limited to observing the absolute and relative dimensions of the individual elements of the closure cap.

The free end of the sealing olive 3 is also clearly rounded-off so that, when the free end of the olive 3 meets a bottle neck, the free end of the sealing olive 3 slides away and is urged inwardly. FIG. 2 shows the plastic screw closure once again in the same sectional plane, but in the condition of the internal screwthread 8 being screwed fast onto an external screwthread 11 of a bottle neck 10. It will be seen that the sealing olive 3 is urged inwardly by virtue of its rounded-off free end coming into engagement with the end face of the bottle neck 10, while the bead 6 bears against the inner cylindrical surface 16 of the bottle neck. It will be seen that in this case the cylindrical olive 3 is displaced inwardly and compressed so that a corresponding elastic return force is produced, which provides for a firm sealing engagement by bearing sealingly against the inside surface 16 of the inner edge 17 of the bottle neck 10.

At the upper outer edge 13 of the bottle neck, sealing integrity is afforded by virtue of engagement with the sealing strip 4 which, when its free rounded-off or bevelled end comes into engagement with the end face of the bottle neck, is displaced outwardly and is then clamped between the outside surface 18 of the bottle neck and a cylindrical bead 5 and is drawn by the bead 5, around the upper outer edge 13 of the bottle neck. The bead 5, as shown in FIG. 1*a* is provided at the transition between the top plate portion and the peripheral portion of the closure cap and has a substantially cylindrical inside surface having a diameter of $2R_i$, of which is at most equal to and preferably somewhat smaller than the sum of the diameter D of the bottle neck and double the thickness of the sealing strip 4. In regard to the details of the good sealing engagement achieved thereby, attention is directed to DE 41 28 474. As the sealing olive 3 is markedly thicker and preferably approximately twice as thick (without having regard to the bead) as the sealing strip 4, the preferred embodiment of the invention provides that the outside diameter $2R_1$ of the sealing olive in the region in which it comes into engagement with the upper edge 17 of the bottle neck involves a smaller difference in relation to the inside diameter d of the edge of the bottle neck in that region than the sealing strip 4 with its inside surface relative to the outside edge of the neck of the bottle as, with the same force acting, the sealing strip 4 is more easily deformable than the sealing olive 3. This can also be clearly seen from FIG. 2 and by the comparison with FIG. 1. The difference in diameter $|d-2R_1|$ between the sealing olive and the inner edge of the bottle neck, when the closure is not screwed onto a bottle neck, is only about a third to a quarter of the difference in diameter $D-2r_2$ between the inside surface of the sealing strip and the outer edge of the neck of the bottle. As such, the deviation $|2R_i-d|$ of the outside diameter $2R_1$ of the sealing olive 3 from the inside diameter d of the bottle neck is markedly less than the deviation $12r_2-D|$ of the inside diameter $2r_2$ of the sealing strip 4 from the outside diameter D of the bottle neck. The ratio of the deviations is at least 1:2, preferably 1:3 to 1:5.

Since both, the sealing olive and the sealing strip preferably comprise the plastic material of the closure, they enjoy sufficient elasticity to be urged away by the edge of the bottle neck when the closure is fitted onto the bottle and is screwed fast, while however coming into very firm sealing engagement with the upper edge of the bottle neck, by virtue of the elastic return forces which occur in that case.

The closure according to the invention provides that both the upper outer edge and also the inside surface of the mouth of the bottle neck is gripped and sealed between two mutually oppositely disposed sealing elements. The arrangement thus affords two virtually equivalent seals which are independent of each other so that, in the event of damage, deformation or deviations in tolerances of the upper edge of the bottle neck having remained unnoticed, there is still a relatively great probability that at least one of the two seals ensures adequate sealing integrity, as it is improbable that damage or deformation which involves both the upper outer edge and also the upper inside surface of the edge of the bottle neck remains unnoticed.

In addition the bottle neck applies to the two sealing elements, radially opposed forces which substantially neutralise each other. That ensures that the top plate portion (or end portion of the closure cap) which carries those forces in the case of conventional seals which are in contact at one side does not yield to those forces due to a slow flow or creep phenomenon, so that the sealing engagement does not become gradually weaker.

What is claimed is:

1. A plastic screw closure intended for sealing a bottle with a threaded bottle neck (10) having an outside diameter (D), an inside diameter (d), a thickness $(1/2|D-d|)$ defined therebetween, an upper outer edge, and an inner surface, said screw closure, before being secured on the bottle neck to which said closure is to be applied, comprising:

a top plate portion (2) which is substantially in the form of a circular disc;

a substantially cylindrical peripheral portion (1) extending from said top plate portion, said peripheral portion having a screwthread (8) adapted to cooperate with the threaded bottle neck and a substantially cylindrical bead (5) adjacent said top plate portion;

a substantially cylindrical deformable sealing strip (4) extending axially from said top plate portion (2) inward of said bead and having an inside diameter (2r2) which is smaller than the outside diameter (D) of the thread bottle neck; and a substantially cylindrical sealing olive (3) extending axially from said top plate portion (2) inward of said deformable sealing strip (4) and having, at least at a portion substantially opposite said deformable sealing strip, an outside diameter (2R1) greater than the inside diameter (d) of the threaded bottle neck (10), wherein when said closure is fitted onto the threaded bottle neck:

said sealing olive is adapted to radially deform inwardly and seal at least substantially along the inner surface of the threaded bottle neck, said deformable sealing strip is adapted to radially deform outwardly at least as large as or greater than the radial inward deformation of said sealing olive and seal at least substantially along the upper outer edge of the threaded bottle neck, and said cylindrical bead is adapted to press said sealing strip against the threaded bottle neck.

2. The plastic screw closure according to claim 1, wherein a first deviation is less than a second deviation, said first deviation defined by the absolute difference between said outside diameter $(2R_1)$ of said sealing olive (3) and the inside diameter (d) of the bottle neck (10), and said second deviation defined by the absolute difference between said inside diameter $(2r_2)$ of the sealing strip (4) and the outside diameter (D) of the bottle neck (10).

3. The plastic screw closure according to claim 2, wherein a ratio between said first and second deviations is at least 1:2.

4. The plastic screw closure according to claim 2, wherein a ratio between said first and second deviations is from about 1:3 to about 1:5.

5. The plastic screw closure according to claim 1, wherein a spacing $(r_2-R_1)$ between said sealing strip (4) and the sealing olive (3) is less than half the thickness of the bottle neck (10) in the region in which said closure comes into scaling engagement with the bottle neck.

6. The plastic screw closure according to claim 1, wherein a spacing $(r_2-R_1)$ between said sealing strip (4) and the sealing olive (3) is less than two thirds the thickness of the bottle neck (10) in the region in which said closure comes into sealing engagement with the bottle neck.

7. The plastic screw closure according to claim 1, wherein said sealing olive (3) includes, on an outside wall thereof, a shallow bead (6) with a cross-section of an obtuse-angled triangle.

8. The plastic screw closure according to claim 7, wherein said sealing olive (3) at its free end, extends in cross-section in a rounded-off and/or beveled configuration which permits said sealing olive to be urged radially inwardly upon axial movement of said screw closure onto the bottle neck.

9. The plastic screw closure according to claim 1, wherein said sealing strip (4) extends in a rounded-off and/or beveled configuration which permits said sealing strip (4) to be urged radially outwards upon axial movement of said screw closure onto the bottle neck.

10. The plastic screw closure according to claim 1, wherein deviations in shape between said substantially cylindrical sealing olive (3) and said substantially cylindrical sealing strip (4) are substantially limited to an outside wall (12) of said sealing olive and an inside wall (13) of said sealing strip.

11. The plastic screw closure according to claim 10, wherein said inside wall (13) of said sealing strip (4) and said outside wall (12) of said sealing olive (3) extend substantially parallel over the greater part of the axial length of the sealing strip.

12. The plastic screw closure according to claim 1, wherein the axial length of said sealing olive (3) is greater than the axial length of the sealing strip (4) by at least 50 percent.

13. The plastic screw closure according to claim 1, wherein the axial length of said sealing olive (3) is greater than the axial length of the sealing strip (4) by at about 100 percent.

14. The plastic screw closure according to claim 1, wherein the mean thickness of said sealing olive (3) is at least twice the thickness of said sealing strip (4).

15. The plastic screw closure according to claim 14, wherein said closure is produced in one piece from a homogenous material.

16. The plastic screw closure according to claim 1, wherein said closure is produced in one piece from a homogenous material.

17. The plastic screw closure according to claim 1, wherein said peripheral portion (1) at a lower edge includes an anti-tamper and tear-off band (7).

18. The plastic screw closure according to claim 1, wherein said surface diameter (2R$_i$) of said bead (5) is smaller than the sum of the outside diameter (D) of the bottle neck and double the thickness of said sealing strip (4).

19. A plastic screw closure intended for sealing a bottle with a threaded bottle neck (10) having an outside diameter (D), an inside diameter (d), a thickness (1/2|D−d|) defined therebetween, an upper outer edge, and an inner surface, said screw closure, before being secured on the bottle neck to which said closure is to be applied, comprising:

a top plate portion (2) which is substantially in the form of a circular disc;

a substantially cylindrical peripheral portion (1) extending from said top plate portion, said peripheral portion having a substantially cylindrical bead (5), adjacent said top plate portion, and a screwthread (8) adapted to cooperate with the threaded bottle neck;

a substantially cylindrical deformable sealing strip (4) extending axially from said top plate portion (2) inward of said bead (5) and having a free end and an inside diameter (2r2) which is smaller than the outside diameter (D) of the threaded bottle neck; and a substantially cylindrical sealing olive (3) extending axially from said top plate portion (2) inward of said deformable sealing strip (4) and having, at least at a portion substantially opposite said free end of said deformable sealing strip, an outside diameter (2R1) greater than the inside diameter (d) of the threaded bottle neck (10).

* * * * *